US006460373B1

(12) United States Patent
Bergman, Jr. et al.

(10) Patent No.: US 6,460,373 B1
(45) Date of Patent: Oct. 8, 2002

(54) CRYOGENIC RECTIFICATION SYSTEM FOR PRODUCING HIGH PURITY OXYGEN

(75) Inventors: Thomas John Bergman, Jr., Clarence Center; Bayram Arman, Grand Island; Minish Mahendra Shah, East Amherst, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/000,318

(22) Filed: Dec. 4, 2001

(51) Int. Cl.[7] ..... F25J 3/00
(52) U.S. Cl. ..... 62/652; 62/654
(58) Field of Search ..... 62/652, 654

(56) References Cited

U.S. PATENT DOCUMENTS

| | | | | |
|---|---|---|---|---|
| 4,755,202 A | | 7/1988 | Cheung | 62/17 |
| 5,049,173 A | | 9/1991 | Cormier Sr. et al. | 62/24 |
| 5,195,324 A | | 3/1993 | Cheung | 62/24 |
| 5,528,906 A | | 6/1996 | Naumovitz et al. | 62/652 |
| 5,590,543 A | | 1/1997 | Agrawal et al. | 62/643 |
| 5,675,977 A | * | 10/1997 | Prosser | 62/652 |
| 5,689,973 A | | 11/1997 | Naumovitz et al. | 62/652 |
| 5,778,698 A | * | 7/1998 | Yamamoto | 62/652 |
| 5,918,482 A | | 7/1999 | Potempa | 62/646 |
| 5,934,104 A | | 8/1999 | Fidkowski et al. | 62/643 |
| 5,941,097 A | * | 8/1999 | Higginbotham et al. | 62/652 |
| 6,050,106 A | | 4/2000 | Yamamoto et al. | 62/643 |
| 6,279,345 B1 | | 8/2001 | Arman et al. | 62/647 |

FOREIGN PATENT DOCUMENTS

EP 798524 5/2001

* cited by examiner

*Primary Examiner*—Ronald Capossela
(74) *Attorney, Agent, or Firm*—Stanley Ktorides

(57) ABSTRACT

A cryogenic rectification system comprising three columns wherein high purity oxygen is produced in the third column which is fed from at least one of the first and second columns, which do not share a common condenser/reboiler, and reboiled using feed air or first column top vapor.

19 Claims, 3 Drawing Sheets

CRYOGENIC RECTIFICATION SYSTEM FOR PRODUCING HIGH PURITY OXYGEN

TECHNICAL FIELD

This invention relates generally to the cryogenic rectification of feed air and, more particularly, to the cryogenic rectification of feed air to produce high purity oxygen.

BACKGROUND ART

High purity oxygen is used in the manufacture of high value components such as semiconductors where freedom from contamination is critical to the manufacturing process. High purity oxygen is generally produced in large quantities by the cryogenic rectification of feed air using a double column plant. The production of high purity oxygen is energy intensive and any system which can produce high purity oxygen with lower power requirements than heretofore available systems would be highly desirable.

Accordingly it is an object of this invention to provide a system for producing high purity oxygen by the cryogenic rectification of feed air which has lower power requirements than do heretofore available comparable conventional systems.

SUMMARY OF THE INVENTION

The above and other objects, which will become apparent to those skilled in the art upon a reading of this disclosure, are attained by the present invention, one aspect of which is:

A method for producing high purity oxygen comprising:

(A) passing feed air at a feed level into a first column and producing by cryogenic rectification within the first column first nitrogen-rich fluid and first oxygen-enriched fluid;

(B) passing first oxygen-enriched fluid from the first column at a feed level into a second column having a top condenser, and producing by cryogenic rectification within the second column second nitrogen-rich fluid and second oxygen-enriched fluid;

(C) passing oxygen-containing liquid taken from above the feed level of at least one of the first column and the second column into the upper portion of a third column and down the third column countercurrently to upflowing vapor to produce high purity oxygen fluid;

(D) vaporizing a first portion of the high purity oxygen fluid by indirect heat exchange with at least one of feed air and first nitrogen-rich fluid to produce said upflowing vapor; and (E) recovering a second portion of the high purity oxygen fluid as product high purity oxygen.

Another aspect of the invention is:

Apparatus for producing high purity oxygen comprising:

(A) a first column and means for passing feed air at a feed level into the first column;

(B) a second column having a top condenser and means for passing fluid from the lower portion of the first column at a feed level into the second column;

(C) a third column having a bottom reboiler and means for passing fluid taken from above the feed level of at least one of the first column and the second column into the upper portion of the third column;

(D) means for providing fluid from the lower portion of the third column to the bottom reboiler, and means for providing fluid from the upper portion of the first column to the bottom reboiler; and (E) means for recovering high purity oxygen from the third column.

A further aspect of the invention is:

Apparatus for producing high purity oxygen comprising:

(A) a first column and means for passing feed air at a feed level into the first column;

(B) a second column and means for passing fluid from the lower portion of the first column at a feed level into the second column;

(C) a third column having a bottom reboiler and means for passing fluid taken from above the feed level of at least one of the first column and the second column into the upper portion of the third column;

(D) means for providing fluid from the lower portion of the third column to the bottom reboiler, and means for providing feed air to the bottom reboiler; and (E) means for recovering high purity oxygen from the third column.

As used herein the term "feed air" means a mixture comprising primarily oxygen and nitrogen, such as ambient air.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the term "top condenser" means a heat exchange device that generates column downflow liquid from column vapor.

As used herein the term "bottom reboiler" means a heat exchange device that generates column upflow vapor from column liquid.

As used herein the terms "turboexpansion" and "turboexpander" mean respectively method and apparatus for the flow of high pressure gas through a turbine to reduce the pressure and the temperature of the gas thereby generating refrigeration.

As used herein the term "subcooling" means cooling a liquid to be at a temperature lower than the saturation temperature of that liquid for the existing pressure.

As used herein the terms "upper portion" and "lower portion" mean those sections of a column respectively above and below the mid point of the column.

As used herein the term "high purity oxygen" means a fluid having an oxygen concentration of at least 90 mole percent.

DETAILED DESCRIPTION

Figure 1:
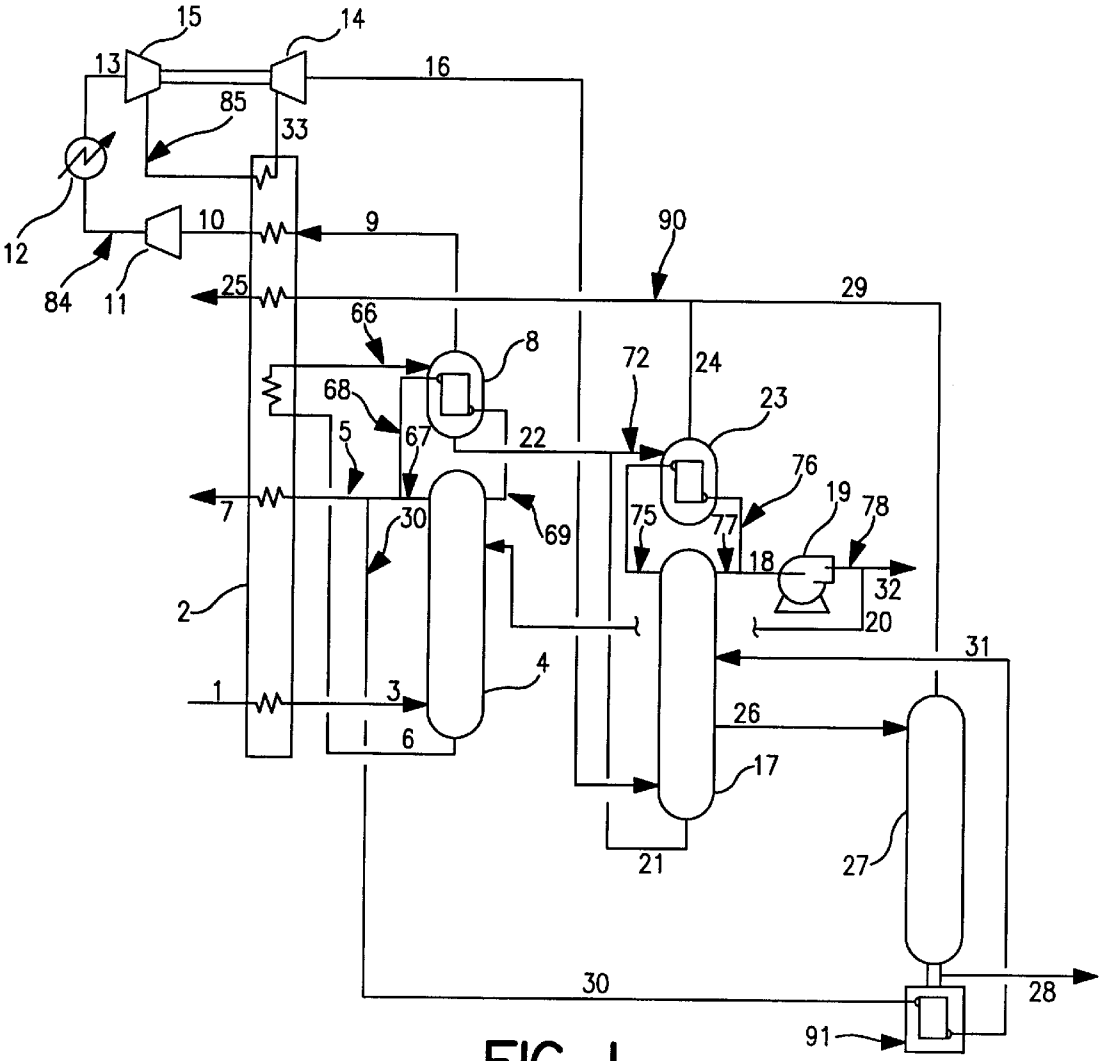
FIG. 1 is a simplified schematic representation of one particularly preferred embodiment of the cryogenic rectification system of this invention.

The invention will be described in detail with reference to the Drawings. Referring now to FIG. 1, feed air 1, which has been cleaned of high boiling impurities such as water vapor, carbon dioxide and hydrocarbons, and is at a pressure generally within the range of from 100 to 300 pounds per square inch absolute (psia), is cooled, preferably to about its dew point by indirect heat exchange with return streams by passage through main heat exchanger 2. Cleaned cooled feed air emerging from main heat exchanger 2 is passed as stream 3 into the lower portion of first column 4.

First column 4 is operating at a pressure generally within the range of from 100 to 300 psia. Within first column 4 the feed air is separated by cryogenic rectification into first nitrogen-rich fluid and first oxygen-enriched fluid. First oxygen-enriched fluid is withdrawn from the lower portion of first column 4 in liquid stream 6, subcooled in main heat exchanger 2 and passed as stream 66 into the boiling side of first column top condenser 8. First column top condenser 8 could be a single stage unit as illustrated in FIG. 1 or could contain one or more rectification stages above the condensing side of the unit.

First nitrogen-rich fluid is withdrawn as vapor stream 67 from the upper portion of first column 4. A first portion 5 of stream 67 is warmed by passage through primary heat exchanger 2 and may be recovered as product nitrogen gas 7 having a nitrogen concentration generally of at least 99 mole percent. A second portion 68 of the first nitrogen-rich vapor is passed into the condensing side of first column top condenser 8 wherein it is condensed by indirect heat exchange with the first oxygen-enriched fluid. The resulting condensed nitrogen-rich liquid is passed in stream 69 from first column top condenser 8 into the upper portion of first column 4 as reflux. A third portion 30 of the nitrogen-rich vapor is used to drive the third column reboiler as will be more fully described below.

First oxygen-enriched liquid 66 is at least partially vaporized by the aforesaid indirect heat exchange with the first nitrogen-rich vapor in first column top condenser 8. The resulting first oxygen-enriched vapor 9 from first column top condenser 8, which typically has an oxygen concentration within the range of from 25 to 50 mole percent, is turboexpanded to generate refrigeration and this refrigeration is used to drive the rectification. The embodiment of the invention illustrated in FIG. 1 is a preferred embodiment wherein the first oxygen-enriched vapor from top condenser 8 is compressed prior to the turboexpansion.

Referring back now to FIG. 1, first oxygen-enriched vapor 9 is warmed in main heat exchanger 2 to form oxygen-enriched vapor stream 10. Stream 10 is compressed by passage through compressor 11 and resulting compressed stream 84 is cooled of the heat of compression in cooler 12 to form stream 13. Oxygen-enriched vapor stream 13 is compressed, generally to a pressure within the range of from 50 to 350 psia, by passage through compressor 15 and compressed oxygen-enriched vapor stream 85 from compressor 15 is cooled by partial traverse through main heat exchanger 2, and resulting cooled compressed oxygen-enriched vapor stream 33 is passed to turboexpander 14 wherein it is turboexpanded to generate refrigeration.

The embodiment of the invention illustrated in FIG. 1 is a particularly preferred embodiment wherein turboexpander 14 is mechanically coupled to compressor 15 thereby serving to drive compressor 15. Refrigeration bearing oxygen-enriched vapor stream 16 from turboexpander 14 is passed into the lower portion of second column 17.

Second column 17 is operating at a pressure generally within the range of from 40 to 150 psia. It is an important aspect of this invention that the first column and the second column do not share a common condenser/reboiler. Within second column 17 the first oxygen-enriched fluid is separated by cryogenic rectification into second nitrogen-rich fluid and into second oxygen-enriched fluid. The second oxygen-enriched fluid is withdrawn from the lower portion of second column 17 as liquid stream 21 and passed into the boiling side of second column top condenser 23. In the case where the first oxygen-enriched fluid is not completely vaporized in first column top condenser 8, the remaining liquid may be passed from the first column top condenser into the boiling side of the second column top condenser. This procedure is illustrated in FIG. 1 wherein remaining oxygen-enriched liquid is withdrawn from first column top condenser 8 in stream 22, combined with stream 21 to form stream 72, and passed into the boiling side of second column top condenser 23.

Second nitrogen-rich fluid is withdrawn as vapor stream 75 from the upper portion of second column 17 and passed into the condensing side of second column top condenser 23 wherein it is condensed by indirect heat exchange with the fluids which were passed into the boiling side of second column top condenser 23. The resulting boil-off vapor is withdrawn from second column top condenser 23 in second oxygen-enriched vapor stream 24. Condensed second nitrogen-rich liquid is withdrawn from second column top condenser 23 in stream 76 and a first portion thereof is passed as stream 77 into the upper portion of second column 17 as reflux. A second portion 18 of second nitrogen-rich liquid 76 is pumped through liquid pump 19 to form pumped nitrogen-rich liquid stream 78. If desired, a portion 32 of stream 78 may be recovered as liquid nitrogen product having a nitrogen concentration generally of at least 99 mole percent. The remainder 20 of stream 78 is passed into the upper portion of first column 4 as additional reflux. Second oxygen-enriched vapor 24 from second column top condenser 23 is warmed by passage through main heat exchanger 2 and removed from the system as stream 25, preferably, as shown in FIG. 1, in combination with top vapor from the third column.

Oxygen-containing liquid, generally having an oxygen concentration within the range of from 5 to 40 mole percent, is withdrawn from second column 17 and passed in stream 26 in the upper portion of third or stripping column 27 which is operating at a pressure generally within the range of from 14.7 to 150 psia. The oxygen-containing liquid is taken from second column 17 at a level which is above the feed level where the first oxygen-enriched fluid is passed into second column 17. Generally the withdrawal level of stream 26 will be from 1 to 20 equilibrium stages above the feed level of stream 16.

The oxygen-containing liquid passed into third column 27 flows down third column 27 against upflowing vapor and in the process lighter components within the downflowing liquid, e.g. argon, are passed into the upflowing vapor while oxygen in the upflowing vapor is passed into the downflowing liquid. This results in the production of high purity oxygen at the bottom of third column 27 and a waste fluid at the top of third column 27. Waste fluid is withdrawn from the upper portion of third column 27 as stream 29 and passed out of the system. Preferably, as illustrated in FIG. 1, stream 29 is combined with stream 24 to form stream 90 which is then warmed by passage through main heat exchanger 2 and removed from the system as aforesaid stream 25.

High purity oxygen liquid is passed into the boiling side of third column bottom reboiler 91 wherein it is reboiled to generate the upflowing vapor used in third column 27. A portion of the high purity oxygen fluid is recovered as product high purity oxygen as shown by product stream 28. The product high purity oxygen may be recovered as liquid before the reboil in reboiler 91, or as vapor after the reboil in reboiler 91, or as both liquid and vapor. First nitrogen-rich vapor in stream 30 is passed into the condensing side of reboiler 91 wherein it condenses thereby serving by indirect heat exchange to vaporize high purity oxygen liquid passed into reboiler 91. Resulting first nitrogen-rich liquid is passed from reboiler 91 in stream 31 into second column 17 wherein it serves as additional input to produce the second nitrogen-rich fluid and second oxygen-enriched fluid.

Figure 2:
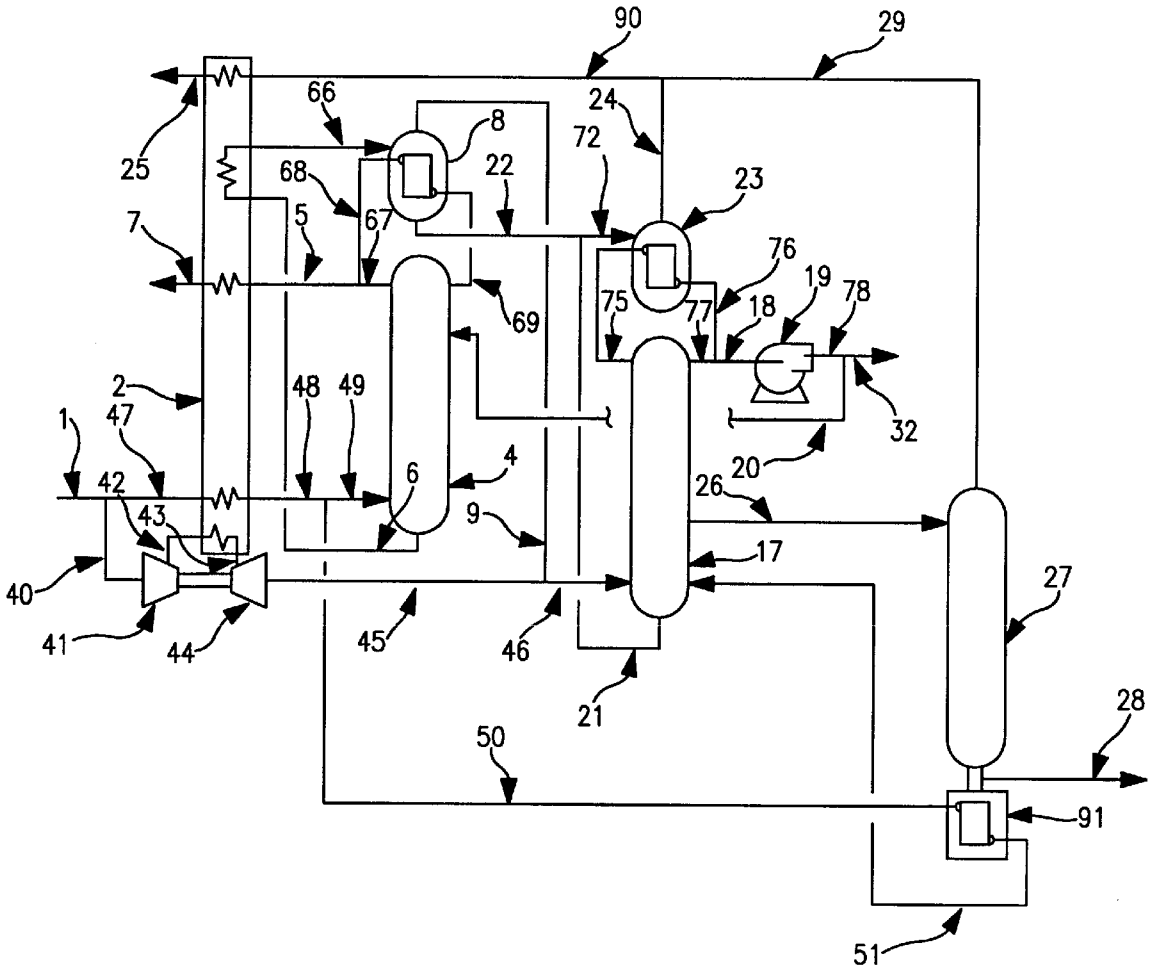
FIG. 2 is a simplified schematic representation of one preferred embodiment of the cryogenic rectification system of this invention.

FIG. 2 illustrates another embodiment of the invention. The numerals of FIG. 2 are the same as those of FIG. 1 for the common elements and these common elements will not be described again in detail.

Referring now to FIG. 2, first oxygen-enriched vapor 9 from first column top condenser 8 is not turboexpanded as in the embodiment illustrated in FIG. 1 but rather is passed directly from first column top condenser 8 into the lower portion of second column 17. In the embodiment illustrated in FIG. 2, a portion 40 of feed air 1 is further compressed by passage through compressor 41 to a pressure generally within the range of from 100 to 350 psia, resulting in a further compressed feed air stream 42 which is cooled by partial traverse of main heat exchanger 2. Resulting cooled feed air stream 43 is turboexpanded by passage through turboexpander 44 to generate refrigeration and resulting refrigeration bearing feed air stream 45 is passed into the lower portion of second column 17 as feed. Preferably, as shown in FIG. 2, stream 45 is combined with stream 9 to form feed stream 46 for passage into the lower portion of second column 17.

A second portion 47 of feed air 1 is cooled by passage through main heat exchanger 2, emerging therefrom as cleaned cooled feed air stream 48. A portion 49 of stream 48 is passed into first column 4 as feed for this column. Another portion 50 of the cleaned cooled feed air from the main heat exchanger is passed into the condensing side of reboiler 91 wherein it is at least partially condensed to vaporize by indirect heat exchange high purity oxygen liquid. The resulting at least partially condensed feed air stream 51 from reboiler 91 is passed into the lower portion of second column 17 as additional input to produce the second nitrogen-rich fluid and second oxygen-enriched fluid.

Figure 3:
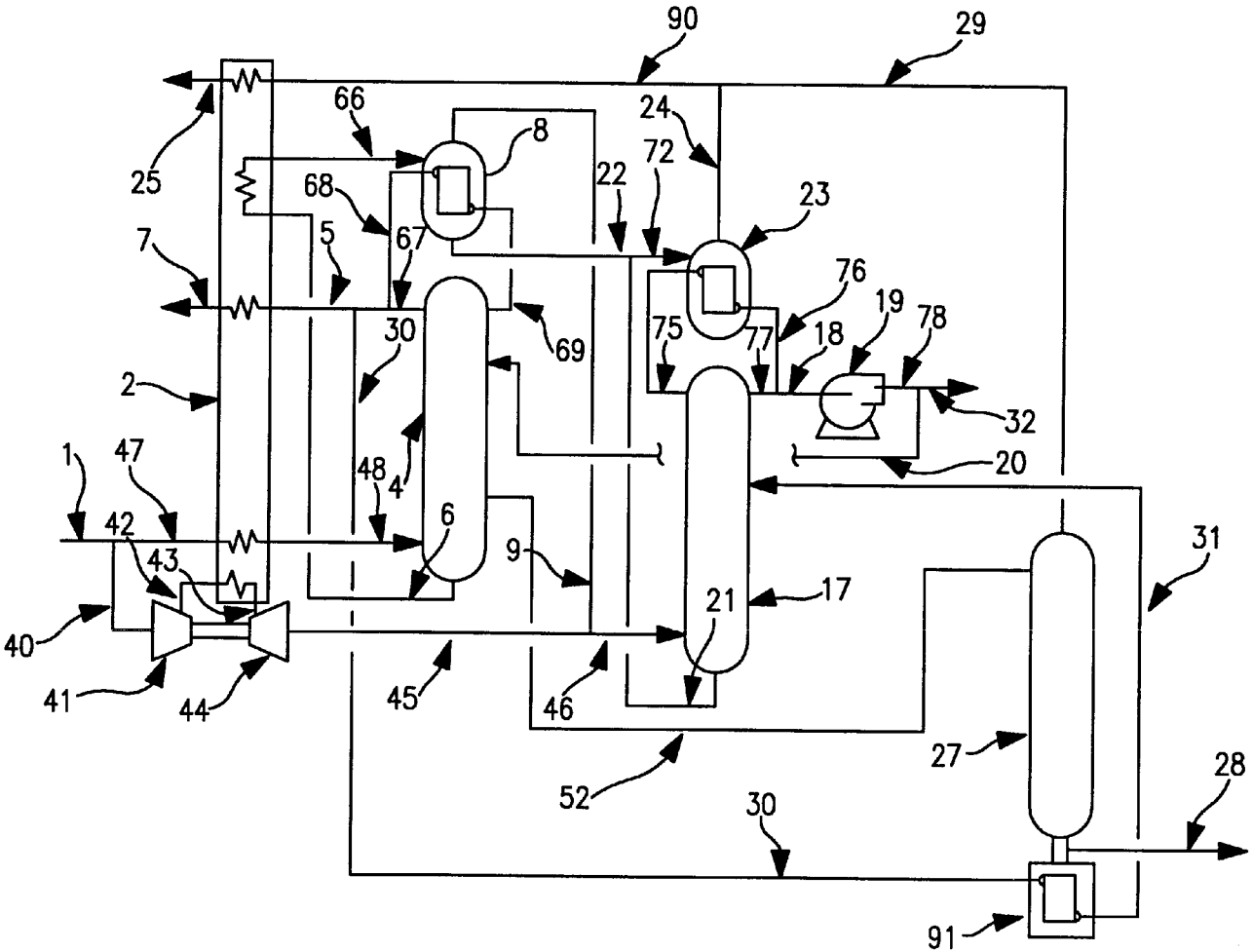
FIG. 3 is a simplified schematic representation of another preferred embodiment of the cryogenic rectification system of this invention.

FIG. 3 illustrates another embodiment of the invention. The numerals of FIG. 3 correspond to those of FIGS. 1 and 2 for the common elements and these common elements will not be described again in detail.

Referring now to FIG. 3, the oxygen-containing liquid fed into third column 27 is not taken from second column 17 as was the case with the embodiments illustrated in FIGS. 1 and 2. In the embodiment of the invention illustrated in FIG. 3, oxygen-containing liquid, generally having an oxygen concentration within the range of from 5 to 40 mole percent, is withdrawn from first column 4 and passed in stream 52 into the upper portion of third column 27. The oxygen-containing liquid in stream 52 is taken from first column 4 at a level which is above the feed level where the feed air is passed into first column 4. Generally the withdrawal level of stream 52 will be from 1 to 20 equilibrium stages above the feed level of feed air stream 48 of the embodiment illustrated in FIG. 3.

To illustrate the advantages of the invention over known systems, there is presented in Table 1 a comparison of the power requirements of one example the invention carried out in accordance with the embodiment illustrated in FIG. 1, reported in column A and one example of the invention carried out in accordance with the embodiment illustrated in FIG. 2, reported in column B, with the power requirements of an example of a comparable known process reported in column C. The known process is that disclosed in U.S. Pat. No. 5,918,482. As can be seen from the data reported in Table 1, the system which employs first nitrogen-rich fluid to drive the third column reboiler enables in this example a better than 9 percent power advantage over the known system, and the system which employs feed air to drive the third column reboiler enables in this example a better than 7 percent power advantage over the known system.

TABLE 1

| | A | B | C |
|---|---|---|---|
| Air Flow (cfh-NTP) | 241,000 | 247,000 | 238,500 |
| Air Pressure (psia) | 144.1 | 143.7 | 176.8 |
| Gaseous Nitrogen Flow (cfh-NTP) | 110,000 | 110,000 | 110,000 |
| Liquid Nitrogen Flow (cfh-NTP) | 1,100 | 1,100 | 1,100 |
| Nitrogen Purity (ppb $O_2$) | 0.3 | 0.3 | 0.3 |
| Nitrogen Pressure (psia) | 134.7 | 134.7 | 134.7 |
| Liquid Oxygen Flow (cfh-NTP) | 2,200 | 2,200 | 2,200 |
| Oxygen Hydrocarbon Content (ppb) | 0.1 | 0.1 | 0.1 |
| Oxygen Argon Content (ppb) | 1.8 | 1.8 | 1.8 |
| Power (kw) | 773.0 | 790.0 | 855.8 |

Although the invention has been described in detail with reference to certain preferred embodiments, those skilled in the art will recognize that there are other embodiments of the invention within the spirit and the scope of the claims.

What is claimed is:

1. A method for producing high purity oxygen comprising:

(A) passing feed air at a feed level into a first column and producing by cryogenic rectification within the first column first nitrogen-rich fluid and first oxygen-enriched fluid;

(B) passing first oxygen-enriched fluid from the first column at a feed level into a second column having a top condenser, and producing by cryogenic rectification within the second column second nitrogen-rich fluid and second oxygen-enriched fluid;

(C) passing oxygen-containing liquid taken from above the feed level of at least one of the first column and the second column into the upper portion of a third column and down the third column countercurrently to upflowing vapor to produce high purity oxygen fluid;

(D) vaporizing a first portion of the high purity oxygen fluid by indirect heat exchange with at least one of feed air and first nitrogen-rich fluid to produce said upflowing vapor; and (E) recovering a second portion of the high purity oxygen fluid as product high purity oxygen.

2. The method of claim 1 wherein the first oxygen-enriched fluid is turboexpanded prior to being passed into the second column.

3. The method of claim 1 wherein the oxygen-containing liquid passed into the third column is taken from the first column.

4. The method of claim 1 wherein the oxygen-containing liquid passed into the third column is taken from the second column.

5. The method of claim 1 wherein the first portion of the high purity oxygen fluid is vaporized by indirect heat exchange with feed air.

6. The method of claim 1 wherein the first portion of the high purity oxygen fluid is vaporized by indirect heat exchange with first nitrogen-rich fluid.

7. The method of claim 1 further comprising turboexpanding a feed air stream and passing the turboexpanded feed air into the second column.

8. Apparatus for producing high purity oxygen comprising:

(A) a first column and means for passing feed air at a feed level into the first column;

(B) a second column having a top condenser and means for passing fluid from the lower portion of the first column at a feed level into the second column;

(C) a third column having a bottom reboiler and means for passing fluid taken from above the feed level of at least one of the first column and the second column into the upper portion of the third column;

(D) means for providing fluid from the lower portion of the third column to the bottom reboiler, and means for providing fluid from the upper portion of the first column to the bottom reboiler; and (E) means for recovering high purity oxygen from the third column.

9. The apparatus of claim 8 further comprising a turboexpander wherein the means for passing fluid from the lower portion of the first column at a feed level into the second column includes the turboexpander.

10. The apparatus of claim 8 comprising means for passing fluid taken from above the feed level of the first column into the upper portion of the third column.

11. The apparatus of claim 8 comprising means for passing fluid taken from above the feed level of the second column into the upper portion of the third column.

12. The apparatus of claim 8 further comprising means for recovering product nitrogen from at least one of the upper portion of the first column and the upper portion of the second column.

13. The apparatus of claim 8 further comprising means for passing feed air into the second column, said means comprising a turboexpander.

14. Apparatus for producing high purity oxygen comprising:

(A) a first column and means for passing feed air at a feed level into the first column;

(B) a second column and means for passing fluid from the lower portion of the first column at a feed level into the second column;

(C) a third column having a bottom reboiler and means for passing fluid taken from above the feed level of at least one of the first column and the second column into the upper portion of the third column;

(D) means for providing fluid from the lower portion of the third column to the bottom reboiler, and means for providing feed air to the bottom reboiler; and (E) means for recovering high purity oxygen from the third column.

15. The apparatus of claim 14 further comprising a turboexpander wherein the means for passing fluid from the lower portion of the first column at a feed level into the second column includes the turboexpander.

16. The apparatus of claim 14 comprising means for passing fluid taken from above the feed level of the first column into the upper portion of the third column.

17. The apparatus of claim 14 comprising means for passing fluid taken from above the feed level of the second column into the upper portion of the third column.

18. The apparatus of claim 14 further comprising means for recovering product nitrogen from at least one of the upper portion of the first column and the upper portion of the second column.

19. The apparatus of claim 14 further comprising means for passing feed air into the second column, said means comprising a turboexpander.

* * * * *